US010716452B2

(12) United States Patent
Sauceda et al.

(10) Patent No.: US 10,716,452 B2
(45) Date of Patent: Jul. 21, 2020

(54) COMPACT DRYING RACK

(71) Applicant: Munchkin, Inc., Van Nuys, CA (US)

(72) Inventors: Samuel Antonio Sauceda, Los Angeles, CA (US); Mark A Hatherill, Agoura Hills, CA (US); Mark Gerard Tebbe, Ventura, CA (US); Kevin Douglas Johnson, Tarzana, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/904,298

(22) Filed: Feb. 23, 2018

(65) Prior Publication Data

US 2018/0235434 A1 Aug. 23, 2018

Related U.S. Application Data

(60) Provisional application No. 62/462,884, filed on Feb. 23, 2017.

(51) Int. Cl.

| | |
|---|---|
| ***A47L 19/04*** | (2006.01) |
| ***A46B 5/00*** | (2006.01) |
| ***A46B 15/00*** | (2006.01) |
| ***A46B 17/02*** | (2006.01) |

(52) U.S. Cl.

CPC ..... *A47L 19/04* (2013.01); *A46B 5/0016* (2013.01); *A46B 5/0095* (2013.01); *A46B 15/0095* (2013.01); *A46B 17/02* (2013.01); *A46B 2200/3006* (2013.01)

(58) Field of Classification Search

CPC .. A47G 21/14; A47G 29/08; A47G 2400/022; A61B 50/20; A47L 19/04; A46B 5/0016; A46B 5/0095; A46B 15/0095; A46B 17/02; A46B 2200/3006

See application file for complete search history.

(56) References Cited

U.S. PATENT DOCUMENTS

| | | | |
|---|---|---|---|
| 499,881 | A | 6/1893 | Goldstein |
| 990,454 | A | 4/1911 | Peters |
| 1,412,592 | A | 4/1922 | Allsop et al. |
| 1,697,879 | A | 1/1929 | Olson |
| 1,822,087 | A | 9/1931 | Feingold |
| 1,942,345 | A | 1/1934 | Ristow |
| 2,039,927 | A | 5/1936 | Poglein |
| 2,128,192 | A | 8/1938 | Risser |
| 2,197,178 | A | 4/1940 | Gates |
| 2,258,676 | A | 1/1941 | De Lano |
| 2,273,761 | A | 2/1942 | Newton et al. |
| 2,295,736 | A | 9/1942 | Jernson |
| 2,328,129 | A | 8/1943 | Earle |
| 2,351,309 | A | 6/1944 | White |
| 2,411,365 | A | 11/1946 | Card |
| 2,419,040 | A | 4/1947 | Stephanian |
| 2,441,417 | A | 5/1948 | Hopkins |
| 2,455,848 | A | 12/1948 | Young |

(Continued)

FOREIGN PATENT DOCUMENTS

| | | | | |
|---|---|---|---|---|
| DE | 3117264 C2 * | 4/1988 | ..... | A61C 19/02 |
| EP | 2465460 A1 * | 6/2012 | | |

*Primary Examiner* — Ko H Chan

(74) *Attorney, Agent, or Firm* — Robert Z. Evora, Esq.

(57) ABSTRACT

A compact drying rack is disclosed having a portable carry case which is opened to reveal various sized pegs to accommodate a variety of different types of bottles and bottle brushes.

7 Claims, 7 Drawing Sheets

(56) References Cited

U.S. PATENT DOCUMENTS 2,472,028 A * 5/1949 Son ..... A61L 2/26 206/365
2,516,088 A 7/1950 Einhorn
2,539,613 A 1/1951 Earle
2,551,140 A 5/1951 Ladewig
2,595,242 A 5/1952 Goodin
2,708,350 A 5/1955 Earle
2,724,329 A 11/1955 Lucas
2,841,288 A 7/1958 Field et al.
2,879,900 A 3/1959 Fox
2,664,708 A 5/1959 Levitt
2,892,733 A 6/1959 Gardner et al.
2,936,898 A 5/1960 Miguez
3,026,628 A 3/1962 Berger, Sr. et al.
3,072,452 A 1/1963 Sleeper
3,126,098 A 3/1964 Geiger et al.
3,150,996 A 9/1964 Johnson
3,193,160 A 7/1965 Veit et al.
3,289,854 A 12/1966 Kauffman
3,321,262 A 5/1967 Mogler
3,339,595 A 9/1967 Pechmann
3,367,044 A 2/1968 Fitch
3,388,808 A 6/1968 Radek
3,451,556 A 6/1969 Macoicz
3,464,566 A 9/1969 Gilson
3,486,804 A 12/1969 Kauffman et al.
3,587,865 A 6/1971 Philips
3,730,354 A 5/1973 Bronstein
3,752,322 A 8/1973 Fiocca et al.
3,886,683 A 6/1975 Hudgin et al.
3,901,728 A 8/1975 Opal
3,984,940 A 10/1976 Reich et al.
3,989,575 A 11/1976 Davies et al.
4,193,588 A 3/1980 Doneaux
4,202,948 A 5/1980 Peascoe
4,221,299 A 9/1980 Taylor
4,238,035 A 12/1980 Kassanchuk
4,457,877 A 7/1984 Love et al.
4,485,929 A 12/1984 Betts, Sr.
4,498,594 A * 2/1985 Elder ..... A47L 15/505 134/137
4,512,489 A * 4/1985 Green ..... B65D 1/38 220/488
4,578,881 A 4/1986 Karlsson
4,589,556 A 5/1986 Peretz
4,708,153 A 11/1987 Hambleton et al.
4,732,291 A 3/1988 McConnell
4,748,993 A 6/1988 Llewellyn
4,830,200 A 5/1989 Zambano et al.
4,832,206 A 5/1989 Cunningham
4,836,392 A 6/1989 Constantino
4,917,248 A 4/1990 Friskney
4,928,841 A 5/1990 Arthurs
5,082,125 A 1/1992 Ninni
5,158,185 A 10/1992 Michael et al.
5,172,810 A * 12/1992 Brewer ..... A61C 3/04 206/368
5,205,419 A 4/1993 Purtilo
5,211,191 A 5/1993 Brown
5,242,255 A 9/1993 Gleffe et al.
D342,191 S 12/1993 Cronk
5,284,170 A 2/1994 Larsen
5,287,636 A * 2/1994 Lafleur ..... A47L 23/205 239/565
5,312,250 A * 5/1994 Ellman ..... A61C 19/02 433/77
5,336,330 A 8/1994 Shumway et al.
5,351,837 A 10/1994 Smith
5,406,717 A 4/1995 Dofka
5,469,635 A 11/1995 Lamontagne et al.
5,480,035 A 1/1996 Smith
5,497,890 A 1/1996 Clark
5,492,237 A 2/1996 Chang
5,494,086 A 2/1996 McBrady et al.
5,507,060 A 4/1996 Quimpo
5,518,126 A 5/1996 Davis
5,555,640 A 9/1996 Ou
5,592,750 A * 1/1997 Eichten ..... D06F 59/02 223/70
5,601,195 A 2/1997 Finola et al.
5,649,630 A 7/1997 Remmler
5,855,219 A 1/1999 Spencer
5,857,473 A 1/1999 Vanover et al.
5,875,563 A 3/1999 Snow
5,884,778 A 3/1999 Freiheit
5,903,944 A 5/1999 Burrell
5,913,527 A 6/1999 Hailston
5,967,000 A 10/1999 Davis
5,996,600 A 12/1999 Ostry
6,038,784 A 3/2000 Dunn et al.
6,073,763 A 6/2000 Allman
6,095,165 A 8/2000 Mastronardi
6,125,548 A 10/2000 Dunn et al.
6,306,219 B1 10/2001 Ofosu-Asante et al.
6,334,540 B1 1/2002 Plutsky
6,363,951 B1 4/2002 Wood
6,394,285 B1 5/2002 Arthurs et al.
6,477,732 B1 * 11/2002 Cline ..... A45D 8/30 132/121
6,571,965 B1 6/2003 Beck et al.
6,612,448 B2 9/2003 Plutsky
6,640,982 B1 * 11/2003 Bjerke ..... A47L 19/04 211/85.15
D488,594 S 4/2004 Miilu et al.
D490,198 S 5/2004 Jerstroem et al.
6,743,299 B1 6/2004 Barton et al.
6,766,591 B1 * 7/2004 McKinney ..... A47L 23/205 34/104
6,814,091 B2 11/2004 McConnell et al.
6,877,616 B2 4/2005 Plutsky
6,907,893 B2 6/2005 Eisenberg et al.
6,907,998 B2 6/2005 Deiss
D533,002 S 12/2006 Recknagel et al.
7,165,562 B2 1/2007 Myong
7,228,975 B2 6/2007 Yang et al.
7,231,929 B2 6/2007 Landsiedel et al.
7,255,229 B2 * 8/2007 Roesler ..... B25H 3/003 206/379
7,344,036 B2 3/2008 Jerstroem et al.
7,478,642 B2 1/2009 Koch et al.
7,549,429 B2 6/2009 Nunomura et al.
D595,914 S 7/2009 Housley
7,591,273 B2 9/2009 Holley
7,644,826 B2 1/2010 Koch et al.
7,682,465 B2 3/2010 Anderson et al.
7,695,572 B2 4/2010 Ahn et al.
7,771,544 B2 * 8/2010 Helfenbein ..... A61C 19/002 134/169 C
RE43,349 E 5/2012 Dunn et al.
RE43,635 E * 9/2012 Dunn ..... F26B 25/18 211/41.6
8,336,156 B1 * 12/2012 Shimazu ..... A47L 19/00 15/164
8,925,742 B1 1/2015 Chitayat et al.
8,925,743 B1 * 1/2015 Lee ..... A47L 19/04 211/41.6
9,669,140 B2 * 6/2017 Paradise ..... A61M 1/062
2003/0047198 A1 3/2003 Fargnoli
2003/0188769 A1 10/2003 Eisenberg et al.
2003/0205258 A1 11/2003 McConnell et al.
2004/0040586 A1 3/2004 Kumar
2004/0060577 A1 4/2004 Dunn
2004/0123885 A1 7/2004 Myong
2005/0178412 A1 8/2005 Koch et al.
2006/0065295 A1 3/2006 Dunn et al.
2006/0191562 A1 8/2006 Nunomura et al.
2006/0208172 A1 9/2006 Akkerman et al.
2006/0260651 A1 11/2006 Holley
2007/0102025 A1 5/2007 Ahn et al.
2007/0212667 A1 9/2007 Jung et al.
2007/0272632 A1 11/2007 Jerstroem et al.

(56) References Cited

U.S. PATENT DOCUMENTS

| | | | | |
|---|---|---|---|---|
| 2007/0274762 | A1* | 11/2007 | Edwards | A46B 5/0016 401/39 |
| 2007/0289212 | A1 | 12/2007 | Shein | |
| 2009/0242000 | A1 | 10/2009 | Jimenez | |
| 2009/0320889 | A1 | 12/2009 | Holley | |
| 2010/0043249 | A1 | 2/2010 | Mulaw | |
| 2013/0248310 | A1* | 9/2013 | Taylor-Phillips | A45C 5/005 190/111 |
| 2014/0013529 | A1* | 1/2014 | Kilgore | A46B 9/005 15/106 |
| 2014/0263111 | A1 | 9/2014 | Micek et al. | |
| 2017/0245730 | A1 | 8/2017 | Dunn et al. | |

* cited by examiner

COMPACT DRYING RACK

CROSS REFERENCE TO RELATED APPLICATIONS

This application claims priority to U.S. Provisional Patent Application Ser. No. 62/462,884, filed Feb. 23, 2017; the content of which is hereby incorporated by reference herein in its entirety into this disclosure.

TECHNICAL FIELD

The subject disclosure relates generally to the field of drying racks. In particular, the subject disclosure relates to compact infant product drying racks.

BACKGROUND

Various types of drying racks have been used extensively in residential and commercial environments. In particular, drying racks for infant products are well utilized in homes with infants or small children. After various containers, dishes, bottles, straws, valves, pumps, nipples, pacifiers, brushes, or other accessories are washed, they are typically placed on a drying rack to allow items to dry and for the extra water to drain. Often these items have a wide variety of shapes. Consequently, organizing these various items can be quite challenging. Additionally, such drying racks are typically stationary and most helpful when used in the home environment because they tend to be large and bulky and too burdensome to transport when traveling.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

In one exemplary embodiment, the present subject disclosure is a compact drying rack kit. The kit includes a housing including two halves which are closeable together; a first set of pegs within an interior of the housing; and a second set of pegs within the interior of the housing, wherein the second set of pegs is longer than the first set of pegs; wherein the second set of pegs is pivotable from a first position where they lay within the interior of the housing, and a second position wherein they extend out from the interior of the housing.

In another exemplary embodiment, the present subject disclosure is a compact drying rack kit. The kit includes a housing including two halves connected by a hinge; a first set of pegs within an interior of the housing; a second set of pegs within the interior of the housing, wherein the second set of pegs is longer than the first set of pegs; and a compact bottle brush assembly which first within the two halves when they are closed together; wherein the second set of pegs is pivotable from a first position where they lay within the interior of the housing, and a second position wherein they extend out from the interior of the housing.

In yet another exemplary embodiment, the present subject disclosure is a compact drying rack kit. The kit includes a housing including two halves which are closeable together; and a first set of pegs within an interior of the housing having a length that is longer than a distance that extends between a closed thickness of the housing; and wherein the second set of pegs is pivotable from a first position where they lay within the interior of the housing, and a second position where the two halves are open relative to each other and the first set of pegs extend out from the interior of the housing.

While various aspects, features, or advantages of the subject disclosure are illustrated in reference to compact drying racks, such aspects and features also can be exploited in various other configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1A:
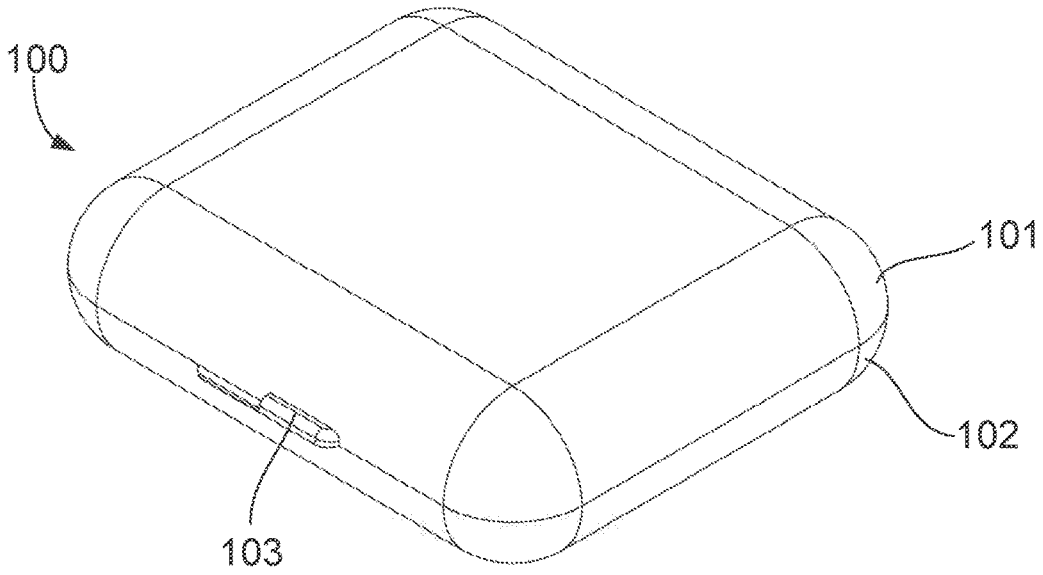
FIG. 1A illustrates a front perspective view of a closed compact bottle drying rack, according to an exemplary embodiment of the present subject disclosure.
Figure 1B:
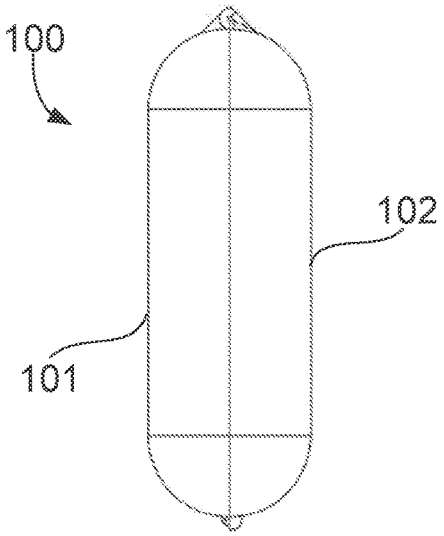
FIG. 1B illustrates a side view of a closed compact bottle drying rack, according to an exemplary embodiment of the present subject disclosure.
Figure 1C:
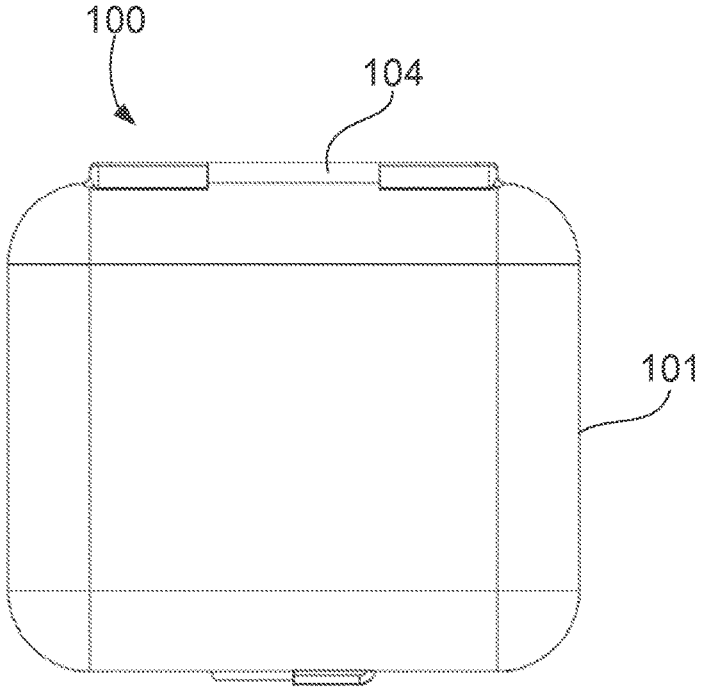
FIG. 1C illustrates a top view of a closed compact bottle drying rack, according to an exemplary embodiment of the present subject disclosure.

Particular embodiments of the present subject disclosure will now be described in greater detail with reference to the figures. As illustrated in FIGS. 1A-1D, an exemplary embodiment of the present subject disclosure is a compact bottle drying rack 100. Although the term "bottle rack" is used conventionally, this rack 100 is not limited to bottles, but may be used to dry any product which it can accommodate. For example, in the exemplary figures, a brush is placed within the compact rack.

The rack 100 shown in FIGS. 1A-1D is closed, which makes it portable, relatively low profile and easy to transport and handle. Parents may take the rack 100 with them while traveling or during extended periods of time outside of the home. The rack 100 may be securely locked with a locking mechanism 103, which may be, for example, a push button or other snap lock, and opened as needed. Small apertures (not shown) may be positioned in the rack assembly 100 to allow for evaporation of any fluid from the interior to the exterior of the rack 100 to prevent mold or bacterial formation.

As illustrated in FIGS. 1A-1D, and 2A-2B, the rack 100 may be opened like a clam shell having two substantially identical halves, including an upper portion or half 101 and a lower portion of half 102, connected through a hinge 104, to reveal the internal holding mechanisms. A series of pegs and slots are evident inside of the compact rack 100. A series of short pegs 110 and a series of long pegs 120 are aligned inside of the compact rack 100. Short pegs 110 may be slideable along a railing 116 inside of the compact rack 100 in order to accommodate various sized bottles or other devices. Optionally, short pegs 110 may also be pivotable to allow for greater flexibility to use as needed. Conversely, short pegs 110 may be locked in position and be immobile.

Long pegs 120 are also shown inside the compact rack 100 and may be positioned on the interior of the upper half 101 or the interior of the lower half 102. The short pegs 110 are generally positioned on the interior of the lower half 102 but may also be positioned on the interior of the upper half 101 as well.

Figure 1D:
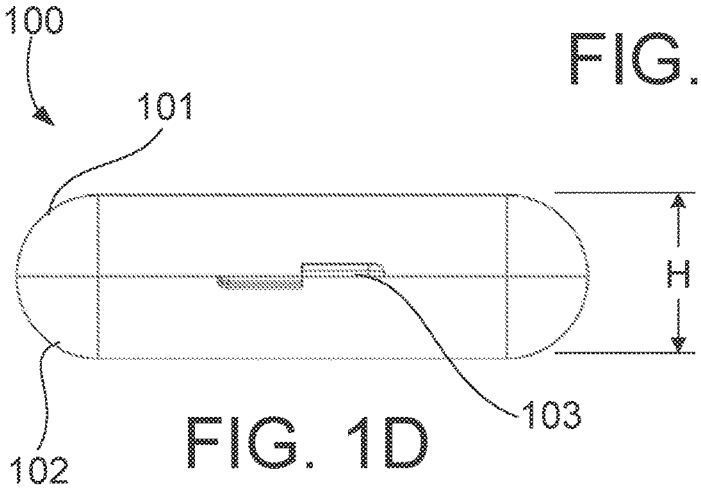
FIG. 1D illustrates a front view of a closed compact bottle drying rack, according to an exemplary embodiment of the present subject disclosure.
Figure 2A:
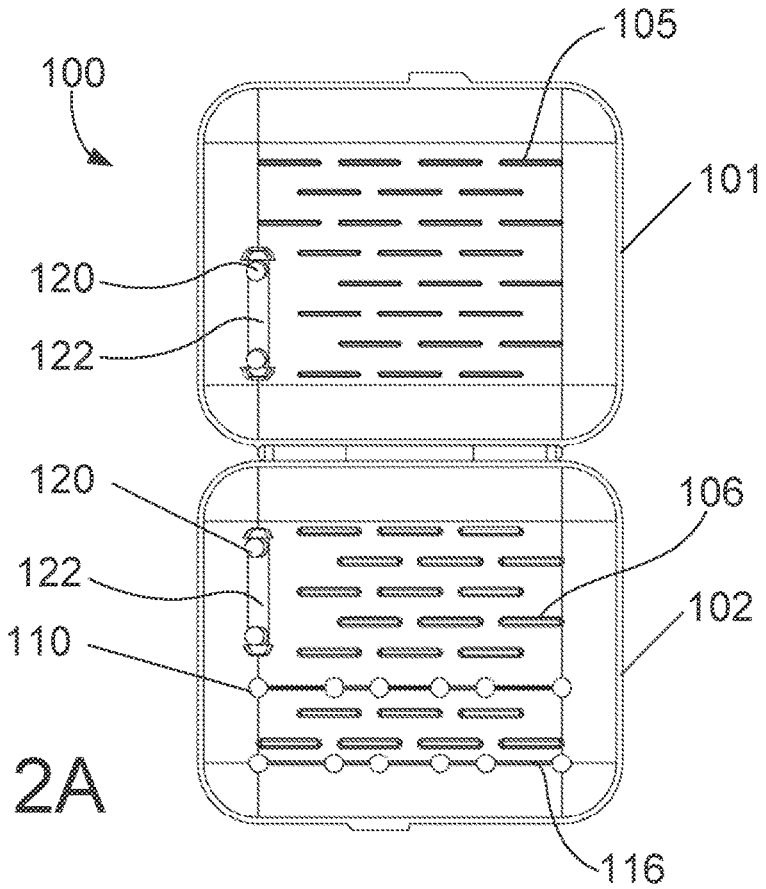
FIG. 2A illustrates a top view of an opened compact bottle drying rack, according to an exemplary embodiment of the present subject disclosure.
Figure 2B:
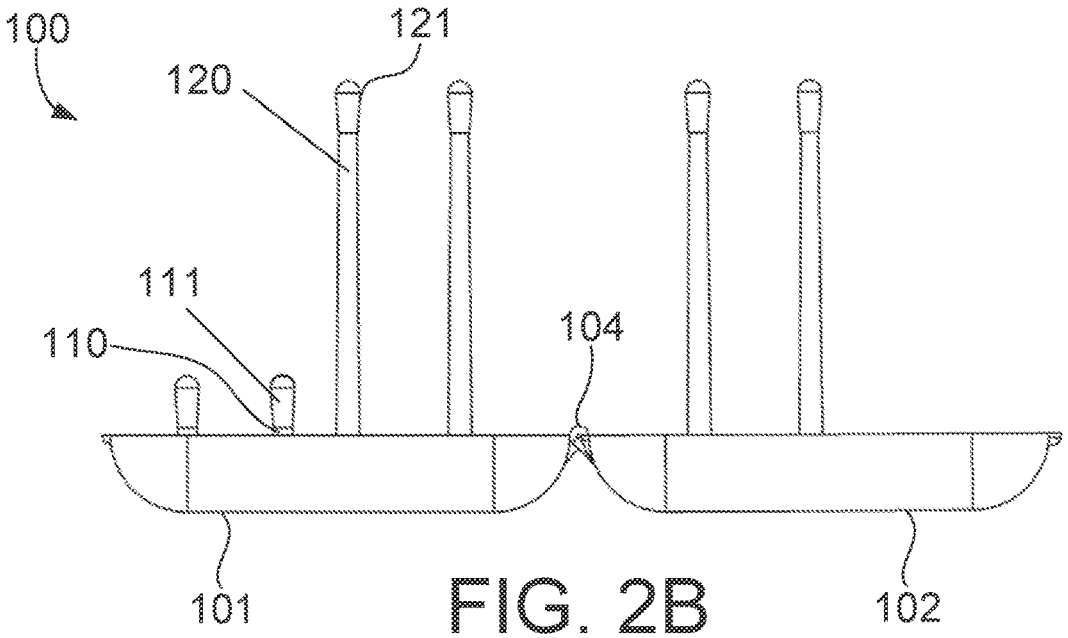
FIG. 2B illustrates a side view of an opened compact bottle drying rack, according to an exemplary embodiment of the present subject disclosure.
Figure 3A:
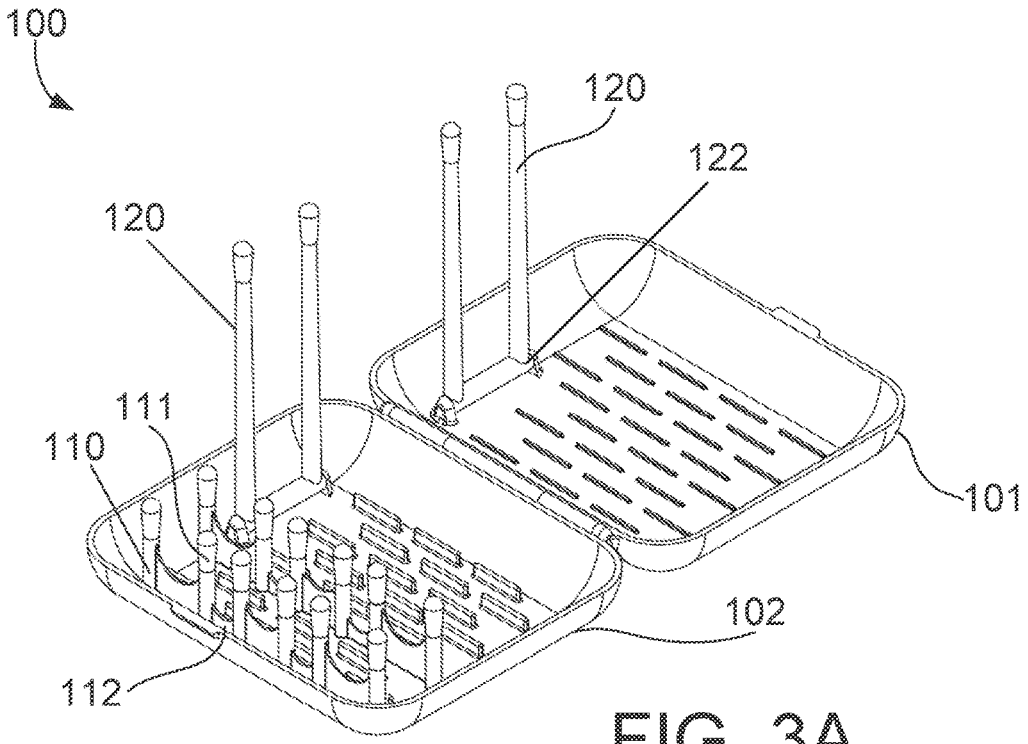
FIGS. 3A-3B illustrate perspective views of an opened compact bottle drying rack from different angles, according to an exemplary embodiment of the present subject disclosure.
Figure 3B:
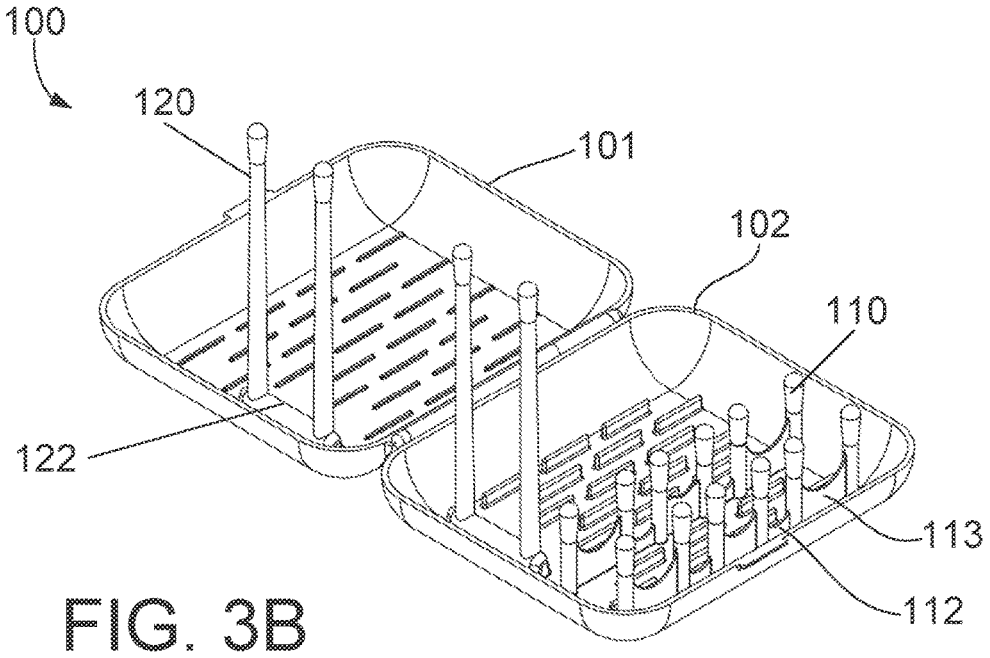

As shown more clearly in FIGS. 3A-3B, the long pegs 120 have a length which is longer than the distance (H) shown in FIG. 1D, extending between the top half 101 and the bottom half 102 when the compact rack 100 is closed. Thus, long pegs 120 cannot stand/extend vertically when the compact rack 100 is closed, like short pegs 110 can, and must be laid down in order for the rack 100 to close (such as in FIG. 1). Thus, each pair of long pegs 120 is mounted on a pivoting base 122 which allows the pair of long pegs 120 to lay flat within the bed of the compact rack 100 when their function is not needed.

When the compact rack 100 is opened for use, the pair of long pegs 120 may be pivoted upwards on the pivoting base 122 to allow the long pegs 120 to extend upward beyond the interior bed of the compact rack 100. In this extended position, the long pegs 120 may house or accommodate various devices or instruments, such as long bottles, which are to be dried on the compact rack 100. Optionally, short pegs 110 may also be pivotable similar to the long pegs 120 to allow for greater flexibility of the combination of short pegs 110 and long pegs 120 in accommodating various sized objects.

Both short pegs 110 and long pegs 120 may be capped with protective caps/covers 111 and 121, respectively, which soften and round out the top portion of each peg. These protective caps 111/121 may be constructed of soft plastic or other similar material which would not cause injury to a user's hands or damage to any product which is to be used in conjunction with the rack 100.

The top half 101 includes a series of components 105 which are complementary to a corresponding series of components 106 in the bottom half 102. These complementary portions are used to secure any device in place, as well as provide structural stability to any object placed within the rack 100 when the rack is opened or closed. In the exemplary embodiment shown in the figures, the series of components 105 in the upper half are shallow channels, and the series of components in the lower half 102 are short projections 106. Other complementary configurations are also possible and within the purview of the present disclosure.

As shown in FIGS. 3A-3B, tall walls 113 and short walls 112 may be used to connect adjoining short pegs 110 in order to further assist in accommodating objects or various sizes. These tall walls 113 and short walls 112 may be pre-installed within pair of adjacent short pegs 110 or may be modular and inserted as needed between adjoining short pegs 110.

Figure 4:
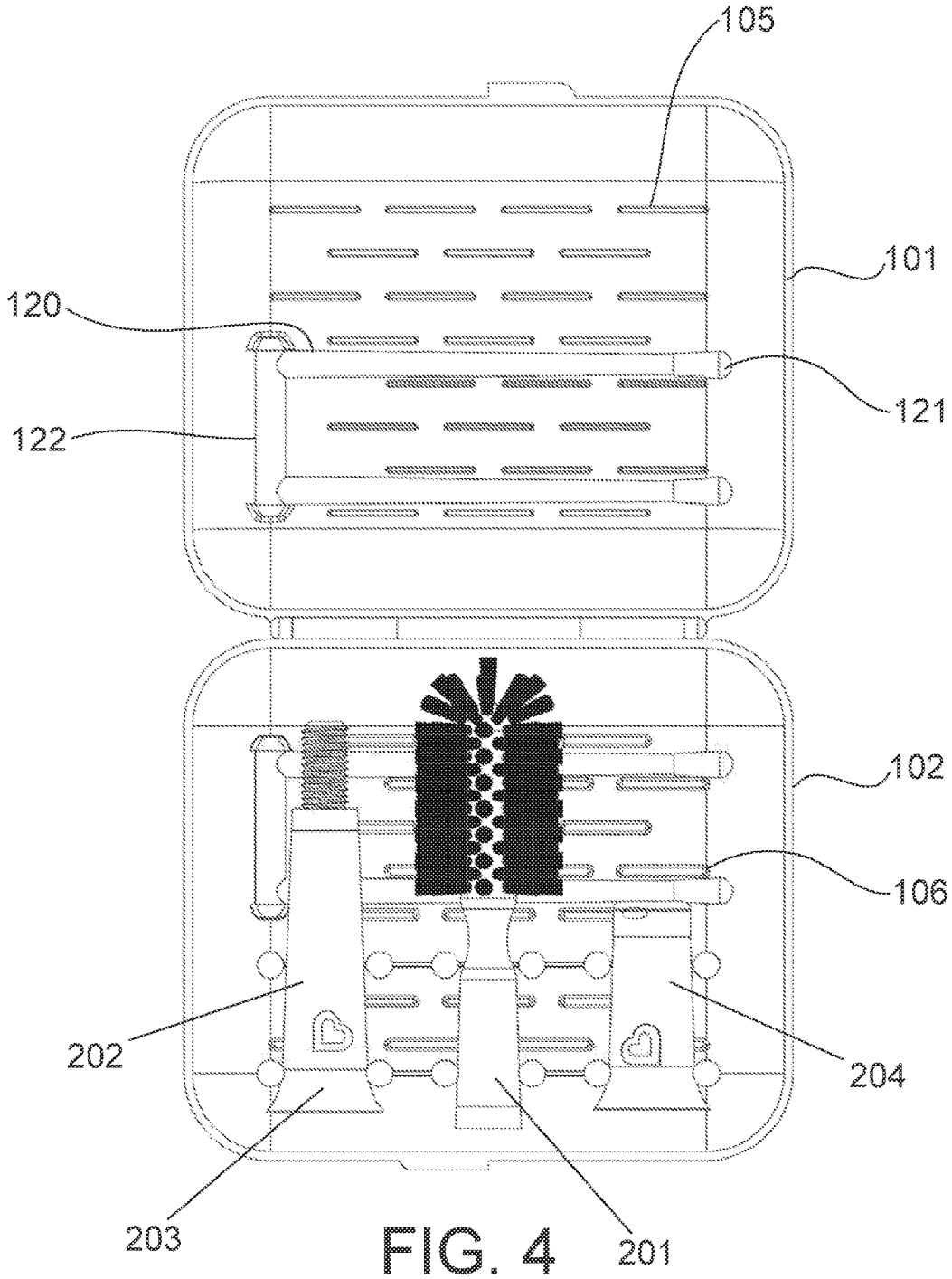
FIG. 4 illustrates a top view of an opened compact bottle drying rack storing a compact brush assembly, according to an exemplary embodiment of the present subject disclosure.
Figure 6:
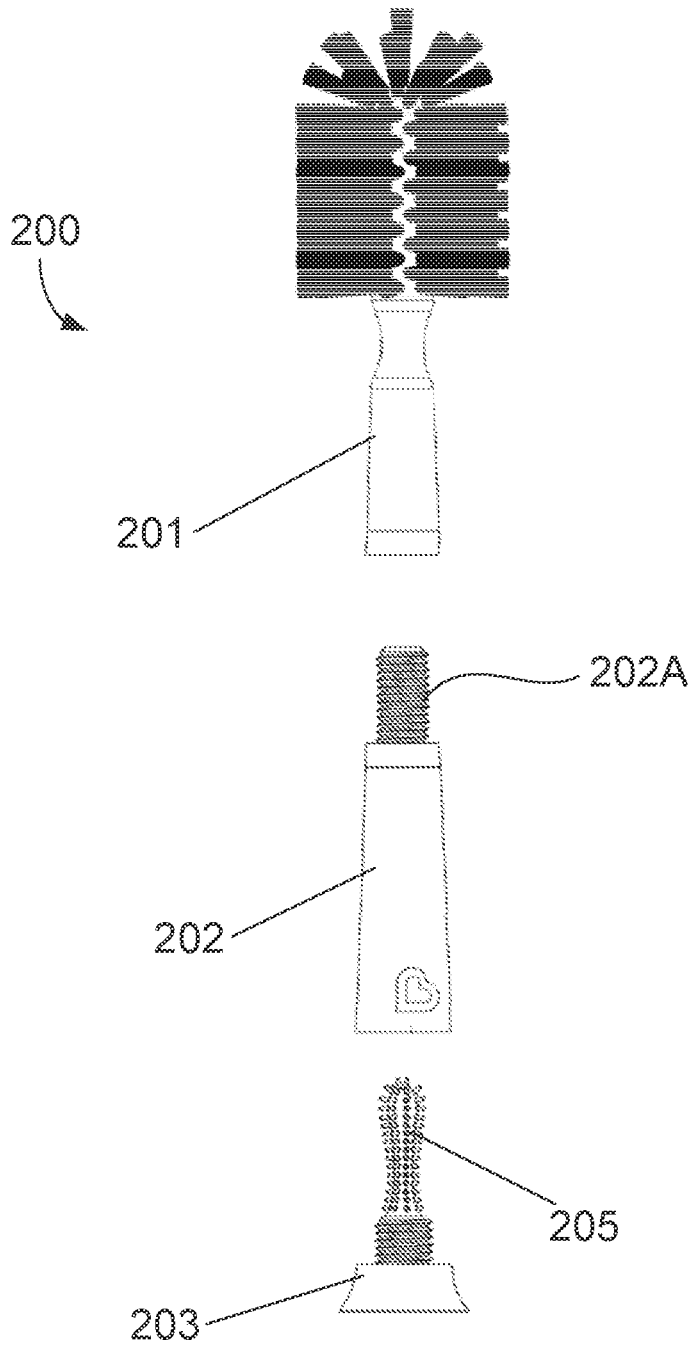
FIG. 6 illustrates a side view of an exploded compact brush assembly, according to an exemplary embodiment of the present subject disclosure.

It may be desirable to carry the compact drying rack 100 with accompanying brush and soap to be able to wash and clean bottles and infant products anywhere outside of the home. In so doing, a compact travel case or kit is illustrated in FIG. 4. A compact brush assembly 200, as shown in FIG. 6, is adapted to fit within the interior peg spacing of the compact drying rack 100. The compact brush assembly 200 includes a top brush portion 201, a middle handle portion 202, and a base 203, along with a container 204 which can store soap or other fluids or cleaning solutions or solids. The top brush portion 201 includes a bristle end and a connecting end, with the connecting end being attachable to a screw mechanism 202A of the middle handle portion. Further, a small nipple brush 205 may be attached to the base 203 and used to clean smaller components, such as small bottles or pacifiers, which are too small for the large bristle of the top brush portion 201. Other configurations are also possible and within the purview of the present disclosure.

Figure 5A:
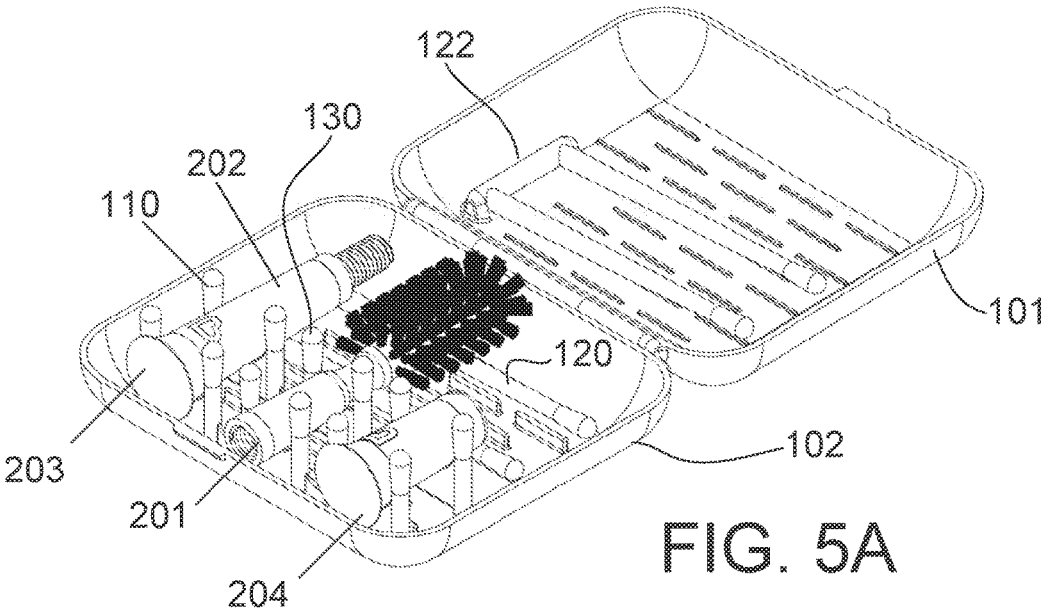
FIG. 5A illustrates a perspective view of an opened compact bottle drying rack storing a compact brush assembly, according to an exemplary embodiment of the present subject disclosure.
Figure 5B:
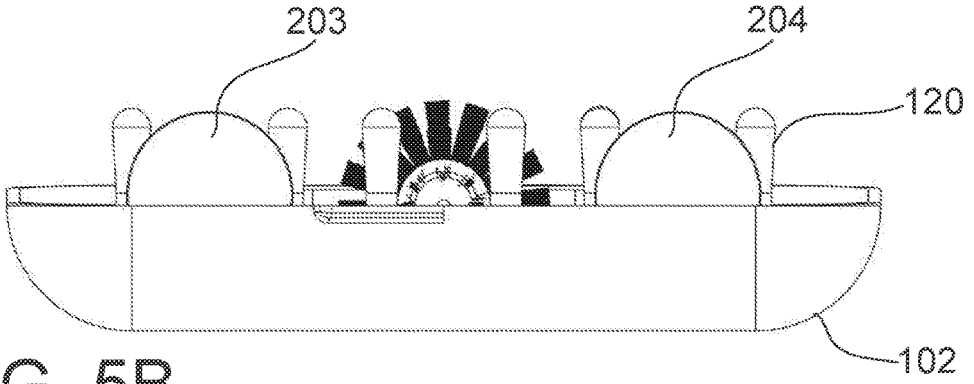
FIG. 5B illustrates a front view of an opened compact bottle drying rack storing a compact brush assembly, according to an exemplary embodiment of the present subject disclosure.
Figure 5C:
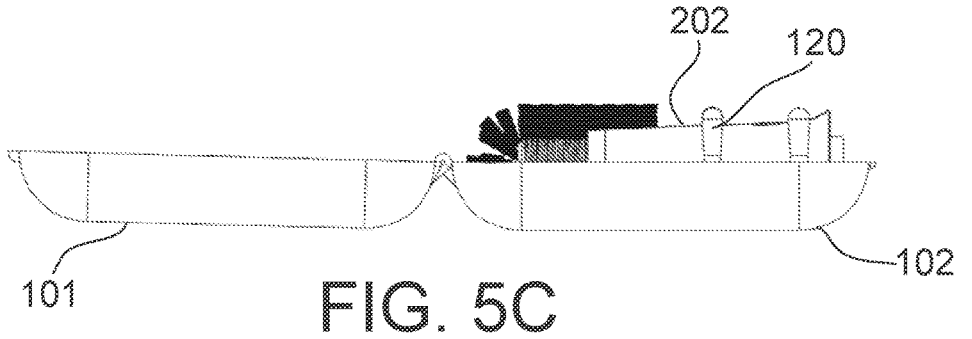
FIG. 5C illustrates a side view of an opened compact bottle drying rack storing a compact brush assembly, according to an exemplary embodiment of the present subject disclosure.

As shown in FIGS. 5A-5C, the compact brush assembly 200 may be stored within the compact drying rack 100 in pre-designated spaces between the short pegs 110 and/or atop the long pegs 120. A third set of very short pegs 130 is also shown. The compact brush assembly 200 and the compact drying rack 100 form a compact portable cleaning kit such that, when needed, the brush assembly 200 is removed from the short pegs 110 of the compact rack 100 and assembled as shown in FIG. 6, and used to wash various bottles and other infant utensils or products. The base 203 may be uncoupled from the handle portion 202 to reveal a nipple brush 205. When washing of bottles is complete, the bottles may be placed on various short pegs 110 and long pegs 120 as needed. The brush assembly 200 may then also be rinsed off and stored back into the compact rack 100 if space allows (bottles are not being dried in the space where the components of the brush assembly 200 usually rest).

In use, the compact rack 100 may be used as described in U.S. patent application Ser. No. 15/439,756, which is incorporated by reference herein in its entirety into this disclosure. The drying technique and various components, functions, and advantages described in the incorporated patent application are applicable in the present subject disclosure.

The present subject matter may be used to store a washing station or transport a washing/drying rack system in a low profile kit. This will allow caretakers of infants and toddlers to carry an effective washing and drying rack system anywhere they travel. The less space it occupies, the easier they will be to transport.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A compact drying rack kit, comprising:

a housing including two halves which are closeable together;

a set of shallow channels within a first half of the housing;

a set of projections within a second Mf of the housing positioned to interact with the shallow channels when the first and second halves are closed;

a compact bottle brush assembly;

a first set of pegs within an interior of the housing; and a second set of pegs within the interior of the housing, wherein the second set of pegs is longer than the first set of pegs;

wherein the second set of pegs is pivotable from a first position where they lay within the interior of the housing, and a second position wherein they extend out from the interior of the housing.

2. The compact drying rack kit of claim 1, wherein the compact bottle brush assembly includes a modular brush portion and a handle portion which are separable from each other.

3. The compact drying rack kit of claim 2, wherein the brush portion and the handle portion are individually stored within the interior of the housing.

4. The compact drying rack kit of claim 3, further comprising a soap container adapted to be stored within the interior of the housing.

5. The compact drying rack kit of claim 1, wherein the first set of pegs are slideable within the interior of the housing.

6. The compact drying rack kit of claim 1, further comprising a plurality of a third set of pegs which are shorter than the first set of pegs.

7. The compact drying rack kit of claim 1, further comprising a hinge to connect the two halves together.

* * * * *